United States Patent [19]

Powell

[11] Patent Number: 4,653,839

[45] Date of Patent: Mar. 31, 1987

[54] CONNECTOR WITH REMOVABLE SOCKET ELEMENTS

[75] Inventor: Lloyd J. Powell, Newmarket, Canada

[73] Assignee: ITT Corporation, New York, N.Y.

[21] Appl. No.: 748,082

[22] Filed: Jun. 24, 1985

[51] Int. Cl.[4] ..... H01R 13/50

[52] U.S. Cl. ..... 339/176 M; 339/248 S; 339/256 R; 339/154 R

[58] Field of Search ..... 339/94 R, 94 M, 248, 339/256, 258, 262, 154 R, 154 A, 156, 36 R, 36 M, 64 R, 64 M, 191 R, 191 M

[56] References Cited

U.S. PATENT DOCUMENTS

| | | | |
|---|---|---|---|
| 2,383,926 | 8/1945 | White | 339/191 M |
| 2,658,183 | 11/1953 | Klostermann et al. | 339/64 M |
| 2,829,358 | 4/1958 | Testori | 339/136 R |
| 3,206,717 | 9/1965 | Brown et al. | 339/256 R |
| 3,924,922 | 12/1975 | De Cenzo | 339/262 R |
| 4,221,447 | 9/1980 | Powell | 339/64 M |
| 4,540,230 | 9/1985 | Iversen et al. | 339/89 M |

FOREIGN PATENT DOCUMENTS 1594183 7/1981 United Kingdom .

*Primary Examiner*—Gil Weidenfeld
*Assistant Examiner*—David L. Pirlot
*Attorney, Agent, or Firm*—T. L. Peterson

[57] ABSTRACT

A connector is described which has socket contacts at one end which can be removed for cleaning or replacement. The connector includes a shell with a hollow end portion, an insulator or web lying within the shell and having a face facing the shell end portion, and a plurality of pin contacts extending through the insulator or web and having ends projected into the shell end portion. A plurality of socket modules each have inner and outer ends that can each receive a pin contact. The inner ends of the modules are mounted on the projecting pin contacts, and the outer ends are free to receive pin contacts of another connector.

3 Claims, 6 Drawing Figures

FIG. 1
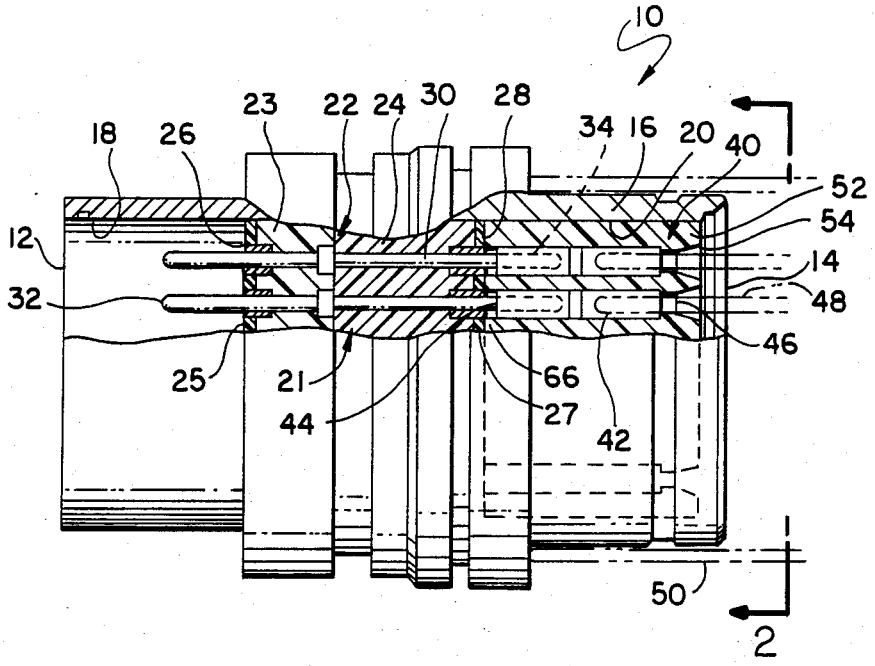
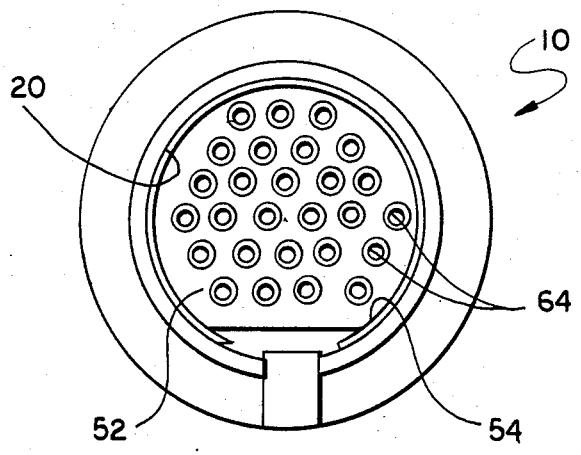
FIG. 2

CONNECTOR WITH REMOVABLE SOCKET ELEMENTS

BACKGROUND OF THE INVENTION

Some connectors are used in a hostile environment such as to make electrical connection deep within an oil well where there is considerable heat and dirt. In some cases, the contacts must be hermetically heat sealed to a ceramic glass, or glass ceramic insulator within the connector. The heat used during sealing may be so high that it destroys the spring temper of most spring materials that could be used in a socket contact that must receive and resiliently press against a pin contact. U.S. Pat. No. 4,221,447, invented by Lloyd J. Powell and owned by the same assignee as the present application, describes a socket contact assembly in which the spring can be installed after the rest of the socket contact has been hermetically sealed in the insulator. While this permits a spring to be used without damaging it by the heat used during heat sealing of the socket contact, it still results in the presence of a permanently installed socket contact portion. Such a socket contact portion with a deep hole for receiving a pin contact, is much more likely to be damaged during use than a simple pin contact which has no recesses. Also, the deep recess of a socket contact portion can be difficult to clean in the field. A connector with socket contacts, for use in a hostile environment, which facilitated replacement and cleaning of the entire socket element would be of considerable value.

SUMMARY OF THE INVENTION

In accordance of one embodiment of the present invention, a connector with socket contacts is provided, for use in a hostile environment, which facilitates removal of the socket contacts for replacement or cleaning. The connector includes a housing forming a shell, an insulator or web lying within the shell, and a group of pin contacts fixed in the insulator and having ends projecting from a face of the insulator. A group of socket modules is provided which each have inner and outer ends that can each receive a pin contact. In the use of the connector to provide socket contacts thereat, the socket modules are installed with their inner ends receiving the pin contacts, a retainer being used to hold the socket modules in place. Another connector with pin contacts can be mated by projecting the pin contacts of the other connector into the outer ends of the socket modules.

Each socket module can include a body with a largely circular middle portion and with arcuate end portions. A hood covers each end portion. A spring lying between the hood and the arcuate end portion of the body presses a pin contact that projects through an end of the hood, against the inside surface of the arcuate end portion of the body.

The novel features of the invention are set forth with particularity in the appended claims. The invention will be best understood from the following description when read in conjunction with the accompanying drawings.

BRIEF DESCRIPTION OF THE DRAWINGS

FIG. 1 is a partially sectional side elevation view of a connector constructed in acordance with one embodiment of the present invention.

FIG. 2 is a view taken on the line 2—2 of FIG. 1.

DESCRIPTION OF THE PREFERRED EMBODIMENT

Figure 6:
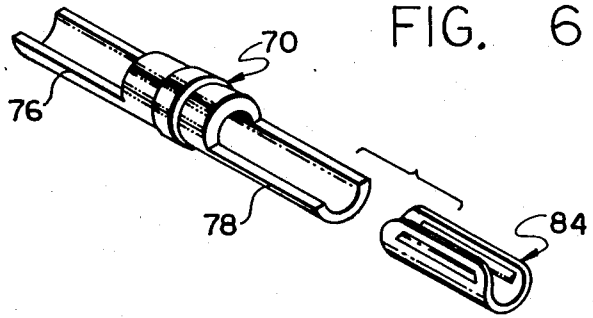
FIG. 6 is an exploded perspective view of a portion of the socket module of FIG. 4.

FIG. 1 illustrates a connector 10 which is designed for use in hostile environments where the connector might be subjected to dirt and corrosive materials. The connector includes a first or male end 12 which is designed to mate with a female connector or "push-on" socket contact or the like, and a second female end 14 designed to mate with a male connector. The connector includes a housing which forms a shell 16 with hollow end portions 18, 20. A pin holding assembly 21 includes an insulator or web 22, which is here shown composed of two insulator plates 23, 24, and is fixed in position within the shell. The holding assembly also includes metal end plates 25, 27 and has opposite faces 26, 28 that respectively face the first and second ends 12, 14 of the connector. The insulator 22 may be replaced by a solid web integral with shell 16 and which contains or fixes in position the pin contacts 30, by individual insulated glass or glass ceramic sealing beads. A group of elongated pin contacts 30 are fixed in place in the insulator or web 22, and each pin contact has a pair of opposite ends 32, 34 that project from opposite faces of the insulator or web into the hollow end portions 18, 20 of the shell.

The portion of the connector which includes just the shell, insulator, and pin contacts, is very rugged and easy to keep clean. Unlike socket contacts which require a deep hole for receiving a pin contact and means for resiliently pressing against the pin contact, a pin contact is a simple projecting rod that does not have to have a spring temper. The pin contacts can be heat sealed in the insulator, at temperatures high enough to melt a glass or other similar sealant, where the temperature would destroy the spring temper of suitable socket contacts. Experience with contacts in hostile environments show that socket contacts are damaged several times more often than pin contacts.

In accordance with the present invention, a socket assembly 40 is installed in one hollow end portion 20 of the shell to form a group of socket contacts therein. The socket assembly includes a plurality of socket modules 42 that each have an inner end 44 that receives a projecting end 34 of a pin contact, and an opposite outer end 46 that can receive the projecting end 48 of a pin contact of a mating connector 50. Both ends 44, 46 of each socket module lie within the hollow end portion 20 of the connector shell so that all portions of the socket modules are encircled and protected by the shell to form a rugged connector with a socket end. The socket assembly 40 includes a retainer 52 that fits at least partially into the hollow shell end 20 to hold the socket modules 42 in place. The retainer 52 is itself releaseably held to the shell, i.e., it can fall out of the shell when not held therein by a snap ring 54. The socket assembly with its socket modules, is installed after the pin contacts 30 have been heat sealed in place, and the socket assembly and its modules can be easily removed and replaced.

Figure 3:
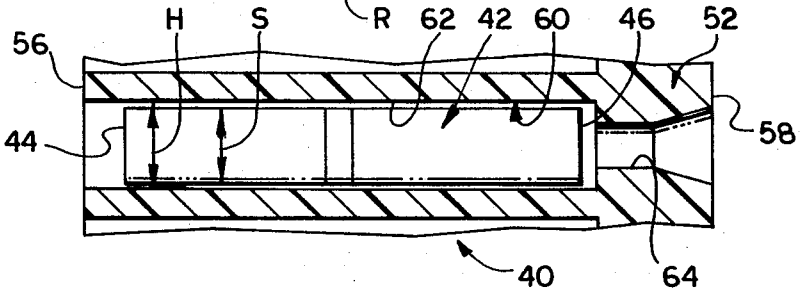
FIG. 3 is a partial sectional view of a portion of the connector of FIG. 1, showing a socket module installed in the retainer.

As shown in FIG. 3, the retainer 52 includes a first or inner face or end 56 which faces a face 28 of the insulator and an opposite second or outer face or end 58. The retainer has a plurality of through holes 60 that extends between its ends. Each hole includes a major portion 62 having a diameter H which is larger than the diameter S of a socket module to receive the socket module therein. The hole diameter H is at least 3% greater than the module diameter S, to permit the socket modules to shift position and/or tilt to accomodate the pin contacts without requiring high precision in hole spacing and diameter. However, the hole diameter H should not be more than about 20% greater than S, or else they will not position the socket modules to receive the pin contacts when the retainer is pushed into the shell.

Each hole 60 includes a constricted portion 64 near the outer end 58 of the retainer that is of smaller diameter than the socket module to prevent its passage therethrough. However, the constricted portion 64 is of a great enough diameter to pass the end of a pin contact that is to be mated to the outer end 46 of the socket module. The major portion 62 of the throughhole is made longer than the lengths of the socket modules, to fully receive them. This allows the inner end 56 of the retainer to be pressed directly against an abutting surface 66 (FIG. 1) at the second end of the connector and from which the ends of the pin contacts project. By making the length of the major portion 62 of the retainer hole somewhat greater than the length of the socket module, the socket module can slide outwardly, in the direction of arrow R, every time a mating connector contact is withdrawn from the outer end 46 of the socket module. This results in the socket module sliding and therefore wiping, against the pin contact end 34 of the connector 10. Also, this facilitates removal of the retainer 52 after the snap ring is removed. The major portion 62 of the throughhole is also made long enough to allow the inner end 44 of each socket module to lie a distance from a surface 66 of the connector.

Figure 5:
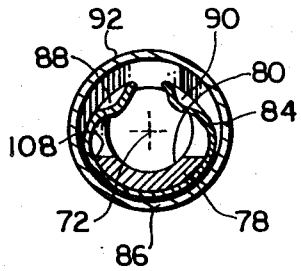
FIG. 5 is a view taken on the line 5—5 of FIG. 4.
Figure 4:
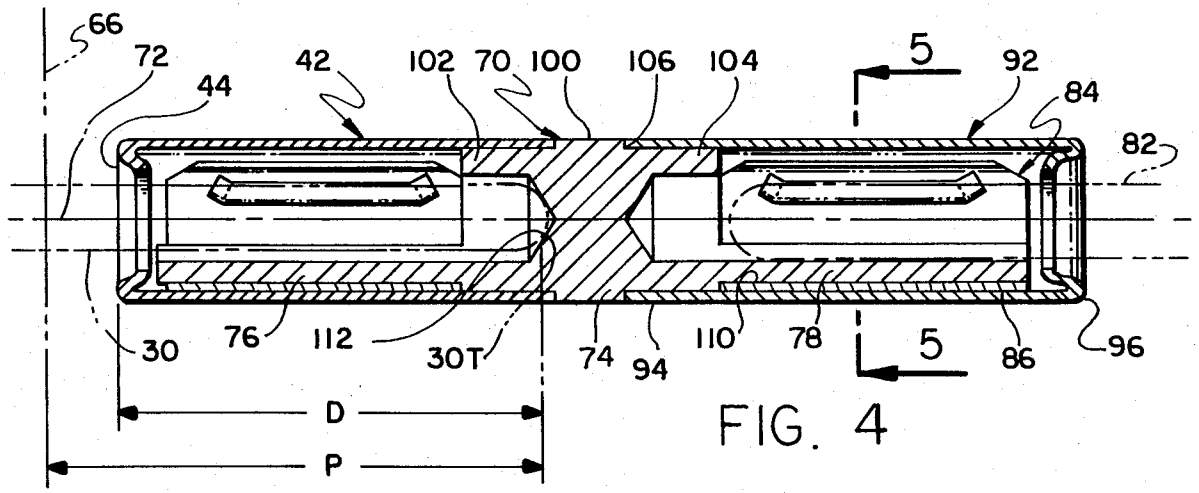
FIG. 4 is a sectional view of the socket module of FIG. 3.

FIG. 4 illustrates details of a socket module 42. The socket module includes a body 70 extending along an axis 72 of the module. The body has a middle 74 and a pair of opposite end portions 76, 78. Each end portion is of arcuate shape but extends (in cross-section) by less than a full circle about the body axis 72. Each end portion has an inside surface 80 (FIG. 5) that is substantially cylindrical, to closely match the outside curvature of a pin contact 82 and 30. The arcuate end portions 76, 78 form socket contacts that can receive and engage a pin contact in wiping contact. A napkin spring 84 is installed at the body end portion, with one side 86 lying under the arcuate end portion, and with the other side forming a pair of free arms 88, 90 (FIG. 5) that press the pin contact 82 against the inside surface 80 of the body end portion.

A hood 92 has an inner end 94 surrounding and attached to the middle 74 of the body, and an outer end 96 lying beyond the end portion 78 of the body. The outer end portion 96 of the hood is constricted, so it can pass a pin contact 82, but prevents the loss of the spring 84. In this socket module, the middle 74 of the body includes a greatest diameter part 100 and two slightly reduced diameter intermediate portions 102, 104 that form ledges 106 against which the inner ends of the hoods abut to limit the insertion distance of the hoods. Each hood is in interference fit with an intermediate portion 102 or 104. However, in this embodiment of the invention, the hoods can be removed, when necessary, in order to replace a napkin spring 84, because they are free of welding to the intermediate body portion. Each end portion such as 78 is of a smaller outside radius (as measured from the axis 72) than each intermediate portion 102, 104, to provide a gap 110 in which the lower side 86 of the spring can lie. The greatest diameter middle part 100 has a length dependent on how far apart are the ends of the two pin contacts that are to be interconnected, and can have a length ranging from zero up to any produceable length.

The body 70 forms an abutting surface 112, which can be engaged by the tip 30T of a pin contact of the connector whose hollow end portion receives the socket assembly. The distance D between the abutting surface 112 and the inner end 44 of the socket module, is less than the length P of the projecting portion of the pin contact 30. This assures that the module ends 44 do not contact the abutting surface 66 of the connector.

Thus, the invention provides a connector for use in hostile environments, wherein only pin contacts are permanently fixed in place, and yet the connector has a socket end portion. This is accomplished by the use of socket modules that lie at least partially within an end of the connector shell and which have one end for receiving a pin contact of the connector and an opposite end for receiving a pin contact of another mating connector. A retainer holds a group of socket modules in place in the connector. Each socket module can include a body with arcuate opposite end portions, a spring having one side anchored behind the arcuate end portion and an opposite side which can press against a pin contact, and a hood which surrounds each end portion of the body. The socket modules can be easily removed for cleaning or replacement, and are not present during the heat sealing of the pin contacts in an insulator of the connector. It is possible for the socket module to be made so that it can be taken apart, as to replace a spring that has been damaged.

Although particular embodiments of the invention have been described and illustrated herein, it is recognized that modifications and variations may readily occur to those skilled in the art and consequently, it is intended that the claims be interpreted to cover such modifications and equivalents.

What is claimed is:

1. A connector comprising:

a shell with a hollow end portion;

an insulator lying within said shell;

a metal end plate having a face that lies at the hollow end portion of the shell;

a plurality of elongated pin contacts fixed in place in said insulator, each pin contact having an end that projects from said insulator and through said metal end plate into said hollow end portions, said pin contact end having a tip;

a plurality of socket modules, each having first and second opposite ends each end forming a pin-receivable socket contact, the first end of each socket module receiving and contacting the end of a corresponding pin contact and having an internal abutting surface that abuts the tip of the pin contact, and the second end of each socket module facing away from the first end to receive a pin contact of another connector, both ends of each socket module lying substantially within said shell hollow end portion to form part of the connector; and retaining means fastened in said shell for retaining said socket modules securely in said shell so they are not pulled out therefrom;

said socket modules being free to slide relative to said retaining means toward said metal end plate with restraint only by the ends of said pin contacts abutting the abutting surfaces of the socket modules, and each pin contact end projects a distance P from a corresponding face of a metal end plate, where P is greater than a distance D between the abutting surface of the socket module and the first end of the socket module, whereby to maintain the end of the socket module away from a face of the end plate.

2. A connector comprising:

a largely cylindrical shell having a hollow end portion;

a plurality of parallel pin contacts lying in said shell with pin contact ends in said hollow end portion and arranged in a predetermined pattern as seen from an end of said shell;

a plurality of socket modules, each having opposite ends forming pin-receiving holes, each module having means for connecting a pair of pins received in its opposite holes;

a retainer constructed of insulative material and formed to fit into said end portion of said shell, said retainer having a plurality of through holes with inner and outer ends arranged in the same pattern as said pin contacts, each hole having a major portion of greater inside width than the outside of said socket modules and at least as long as the modules to receive them, the major hole portion extending to the inner end of the hole so the socket modules can be inserted and removed from the inner end of the holes, but each retainer hole having a constriction near its outer end which prevents the passage of a socket module while passing a pin contact of another connector;

each socket module lying in a retainer hole, said retainer lying in said first end portion of said shell, and each socket module receiving an end of one of said pin contacts;

said retainer being releasably held in said shell end portion so the retainer can fall out of the shell end when oriented to fall out; and a releasable fastener holding said retainer in place, whereby to enable cleaning and/or replacement of socket modules in the field.

3. The connector described in claim 2 wherein:

said releasable fastener is a snap ring, said shell having a groove for holding the snap ring.

* * * * *